United States Patent [19]

Gray et al.

[11] 4,000,480

[45] Dec. 28, 1976

[54] SWITCHING DEVICE

[75] Inventors: Eoin Wedderburn Gray, Columbus, Ohio; Daniel Vincent McCaughan, Great Malvern, England

[73] Assignee: Bell Telephone Laboratories, Incorporated, Murray Hill, N.J.

[22] Filed: Mar. 31, 1975

[21] Appl. No.: 563,801

[52] U.S. Cl. ..... 335/129; 200/146 R; 335/201

[51] Int. Cl.[2] ..... H01H 1/20; H01H 9/38

[58] Field of Search ..... 335/201, 129, 200; 200/146 R

[56] References Cited

UNITED STATES PATENTS

| | | | |
|---|---|---|---|
| 2,499,420 | 3/1950 | Sakatos | 200/146 R |
| 3,371,414 | 3/1968 | Gwyn, Jr. | 200/266 |
| 3,805,200 | 4/1974 | Suzuki | 335/201 |

OTHER PUBLICATIONS

The Bell System Technical Journal, "A New General Purpose Relay For Telephone Switching Systems".

*Primary Examiner*—Harold Broome
*Attorney, Agent, or Firm*—A. A. Tirva

[57] ABSTRACT

A switching device includes a combination of a fixed contact, first and second electrically connected movable contacts, and an arrangement for moving the movable contacts so that the first movable contact closes to the fixed contact before the second movable contact closes to the fixed contact and so that the first movable contact opens from the fixed contact after the second movable contact opens therefrom.

4 Claims, 6 Drawing Figures

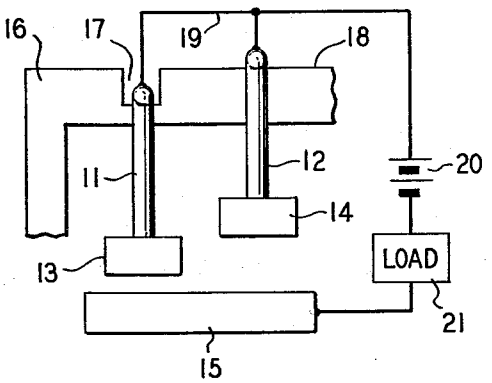
FIG. 1A
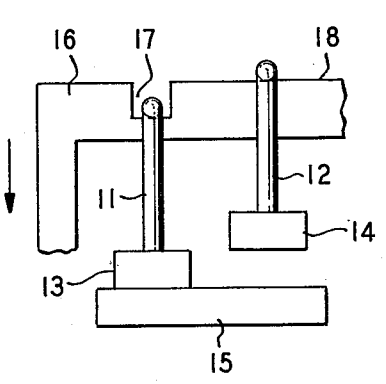
FIG. 1B
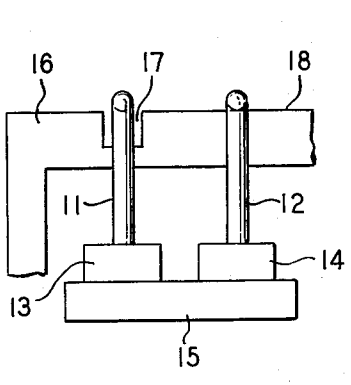
FIG. 1C
FIG. 1D
FIG. 1E
FIG. 2

SWITCHING DEVICE

BACKGROUND OF THE INVENTION

The invention relates to a switching device which is more particularly described as a device wherein metallic contacts are used as switching elements.

The opening and closing of contacts are the primary objectives of switching devices utilizing metallic contacts as switching elements. Thus, it is important in many applications of such devices that the contacts themselves are made reliable and long lasting. Relays used in telephone switching circuits, distributor points used with internal combustion engines, and starting relays used with various household appliances are several of the many possible applications requiring long lasting, reliable contacts. For instance, contacts of switching devices used in telephone switching circuits are expected to provide reliable service for 40 years or more. A long lasting contact has to resist erosion caused by electrical arcing in order to maintain a reasonably low electrical resistance.

Studies have shown that erosion of contacts on closure and separation is caused almost entirely by electrical arcs occurring between two mating contact surfaces when there is potential difference between the two surfaces. When there is no arcing between two mating contact surfaces, there is no erosion, and contact life is then generally limited by mechanical wear of the contact surfaces.

In a switching device, such as a wire spring relay shown in U.S. Pat. No. 2,562,091 issued to H. C. Harrison, arcing erosion of mating contact surfaces is a problem in that it increases the contact resistance and reduces the useful life of the contacts.

Therefore it is an object to provide a switching device having reliable, extended life contacts.

Another object is to improve the operation of a switching device by reducing the effect of erosion caused by arcing.

These and other objects are realized in an illustrative embodiment of the invention in which a switching device has a fixed contact and first and second electrically connected, movable contacts. The movable contacts are moved so that the first movable contact closes with the fixed contact before the second movable contact closes to the fixed contact and so that the first movable contact opens from the fixed contact after the second movable contact opens therefrom.

One embodiment is arranged for moving the two movable contacts so that the first movable contact closes with the fixed contact before the second movable contact closes to the fixed contact and so that the first movable contact opens from the fixed contact after the second movable contact opens therefrom.

In another embodiment, the first contact is made of a material which resists erosion caused by electrical arcs.

BRIEF DESCRIPTION OF THE DRAWING

A better understanding of the invention may be derived from the detailed description as that description is considered with respect to the attached drawings in which:

FIGS. 1A through 1E show an illustrative embodiment of the invention; and

FIG. 2 shows an alternative embodiment of the invention.

DETAILED DESCRIPTION

FIGS. 1A through 1E show a time sequence of operation of a part of a relay (switching device) having a fixed contact 15 and first and second movable contacts 13 and 14 which are attached to free ends of wire springs 11 and 12, respectively. A conductor 19 connects the two wire springs 11 and 12 holding the contacts 13 and 14 at the same potential. A battery 20, having a load 21 in its circuit, establishes a potential between the two movable contacts 13 and 14 and the fixed contact 15.

The same designations are used in all of the FIGS. to identify the same parts. Electrical connection 19, battery 20, and load 21 are only shown in FIG. 1A.

Construction and operation of a relay utilizing fixed contacts, wire springs, and an armature card for moving the wire springs are well known in the prior art. They are discussed in U.S. Pat. No. 2,682,585, issued to H. M. Knapp et al.

Referring now to FIG. 1A there is shown the relay in the unoperated condition with an armature card 16 in a position which keeps the movable contacts 13 and 14 separated from the fixed contact 15. Armature card 16 has a recess 17 in its upper edge 18, which recess permits wire spring 11 to assume an initially lower vertical position relative to its twin wire spring 12 and thus positions contact 13 closer to the fixed contact 15 than contact 14 is positioned thereto.

FIG. 1B shows the relay in a partially operated condition. Armature card 16 moves down a distance sufficient to close the movable contact 13 to the fixed contact 15. Before contact 13 closes to the fixed contact 15, arcing occurs when the two contacts are sufficiently close to each other for an electrical arc (discharge) to be initiated. The distance across which arcing between the two contacts starts depends upon the potential difference between the two contacts, contact surface area, and metallurgical composition of each contact. Arcing continues from contact 13 to contact 15 until contact 13 closes to contact 15. Contact 13 suffers some electrical erosion while contact 14 does not, because the distance separating contacts 14 and 15 is sufficient to prevent arcing. After contact 13 closes to contact 15, contacts 13, 14 and 15 are all at the same electrical potential.

FIG. 1C shows the armature card 16 having moved further down to a position which permits the second movable contact 14 to close with the fixed contact 15. No electrical arcing takes place between contacts 14 and 15 because both contacts are at the same electrical potential. Thus contact 14 mates with contact 15 without any arcing or erosion.

FIG. 1D shows the start of the contact opening sequence. The relay is deenergized, and the armature card 16 moves upward to return the two movable contacts 13 and 14 to their unoperated position. The second movable contact 14 is shown separated from the fixed contact 15. During separation of the two contacts no arcing takes place because both contacts 14 and 15 are kept at the same electrical potential by the continuing closure of the first movable contact 13 to the fixed contact 15 and the path through lead 19. Thus contact 14 separates from contact 15 without any arcing or erosion.

FIG. 1E shows the armature card 16 moved up to a vertical position which forces the first movable contact 13 to separate from the fixed contact 15. Arcing takes place when contact 13 separates from the fixed contact 15, because as soon as the two contacts separate their mating surfaces are at different electrical potentials, and arcing starts. Arcing continues, causing some erosion of contact 13, until contact 13 has moved a distance away from the fixed contact 15, which distance is sufficiently great to terminate electrical discharges between the two contact surfaces. Thus erosion occurs on contact 13 during both closing and opening but not on contact 14, which retains a good low resistance characteristic for a long lifetime.

Referring now to FIG. 2, there is shown an alternative embodiment of the invention which is adapted to further reduce the effect that erosion, caused by arcing between mating contact surfaces, has upon the life of mating contacts.

The arrangement shown in FIG. 2 is substantially the same as shown in FIGS. 1A through 1E except that the first movable contact 23 is made of a material which is resistant to erosion caused by electrical arcing. Thus erosion is slower providing a longer lifetime. One of such materials is an alloy of palladium-nickel. Alloys with 10 percent to 80 percent nickel are recommended for contacts which are exposed to electrical arcs. Because of its low erosion, palladium-nickel is well suited for contact 13 even though the alloy has a higher resistivity than other materials used for electrical contacts. A low resistance path is provided through contact 14 which is free of erosion and provides a good, low resistance contact at all times it is closed.

It is to be understood that the above-described embodiments are illustrative of the application of the principles of the invention. While the instant embodiments are shown and described as a switching device utilizing wire springs in a relay, this is merely for exemplary purposes and should in no way be construed as limiting the invention to wire springs or, for that matter, to wire spring relays. The described arrangement could be utilized to extend contact life in starting relays used in various household appliances or in distributor points used with internal combustion engines to name a few. Numerous other arrangements may be devised by those skilled in the art without departing from the spirit and scope of the invention.

What is claimed is:

1. A relay comprising:

a fixed contact;

first and second wire springs each wire spring having a free end and a fixed end, the wire springs connected electrically at their fixed ends;

a contact attached to the free end of each of the wire springs; and an insulating armature card means moving the free ends of the two wire springs so that the contact of the first wire spring closes to the fixed contact before the contact of the second wire spring closes to the fixed contact and so that the contact of the first wire spring opens from the fixed contact after the contact of the second wire spring opens from the fixed contact.

2. A relay in accordance with claim 1 wherein the insulating armature card means includes a recess for positioning the first wire spring closer to the fixed contact than the second wire spring is to the fixed contact when the contacts are open.

3. A relay in accordance with claim 1 wherein the contact of the first wire spring is of a material which resists erosion caused by electrical arcs.

4. A relay in accordance with claim 3 wherein the electrical erosion resistant material is an alloy of palladium-nickel.

* * * * *